US008366391B2

(12) United States Patent
Tsukagoshi et al.

(10) Patent No.: US 8,366,391 B2
(45) Date of Patent: Feb. 5, 2013

(54) TURBINE BLADE STRUCTURE

(75) Inventors: Keizo Tsukagoshi, Hyogo (JP); Tomoko Hashimoto, Hyogo (JP); Satoshi Hada, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 609 days.

(21) Appl. No.: 12/596,224

(22) PCT Filed: Apr. 23, 2009

(86) PCT No.: PCT/JP2009/058080

§ 371 (c)(1),
(2), (4) Date: Oct. 16, 2009

(87) PCT Pub. No.: WO2009/136550

PCT Pub. Date: Nov. 12, 2009

(65) Prior Publication Data

US 2011/0142597 A1 Jun. 16, 2011

(30) Foreign Application Priority Data

May 8, 2008 (JP) ..... 2008-122460

(51) Int. Cl.
*F01D 5/12* (2006.01)

(52) U.S. Cl. ..... 416/95; 416/97 R; 416/233; 416/500

(58) Field of Classification Search ..... 416/95, 416/96 A, 96 R, 97 R, 232, 233, 500
See application file for complete search history.

(56) References Cited

U.S. PATENT DOCUMENTS 5,193,980 A * 3/1993 Kaincz et al. ..... 416/97 R
5,498,137 A * 3/1996 El-Aini et al. ..... 416/229 A
6,120,244 A * 9/2000 Fukura ..... 415/115

(Continued)

FOREIGN PATENT DOCUMENTS

JP 60228705 A * 11/1985
JP 06-042301 A 2/1994

(Continued)

OTHER PUBLICATIONS

International Search Report and Written Opinion for PCT/JP2009/058080, dated Jun. 23, 2009.

(Continued)

*Primary Examiner* — Igor Kershteyn
*Assistant Examiner* — Christopher R Legendre
(74) *Attorney, Agent, or Firm* — Kanesaka Berner & Partners LLP

(57) ABSTRACT

Provided is a turbine blade structure that is capable of suppressing quality variations of cast products during the manufacturing of turbine blades. A turbine blade structure wherein the space inside an air foil is divided into a plurality of cavities, partitioned by rib members provided substantially perpendicular to the center line connecting a leading edge and a trailing edge, is provided with partition members that partition the inside of the cavities located in the central portion of the blade, excluding the blade leading-edge side and the blade trailing-edge side, into blade pressure side cavities and blade suction side cavities substantially along the center line, wherein blade leading-edge end portions and blade trailing-edge end portions of the partition members are inserted from one shroud surface side to the other shroud surface side along engagement grooves formed on the rib members.

3 Claims, 4 Drawing Sheets

U.S. PATENT DOCUMENTS

| | | | | |
|---|---|---|---|---|
| 6,238,182 | B1 * | 5/2001 | Mayer | 416/96 A |
| 6,386,827 | B2 * | 5/2002 | Yu et al. | 415/136 |
| 2011/0142597 | A1 * | 6/2011 | Tsukagoshi et al. | 415/115 |

FOREIGN PATENT DOCUMENTS

| | | | |
|---|---|---|---|
| JP | 09-041903 | A | 2/1997 |
| JP | 11002103 | A | 1/1999 |
| JP | 2001065305 | A | 3/2001 |
| JP | 2001140602 | A1 | 5/2001 |

OTHER PUBLICATIONS

Notice of Allowance for KR10-2009-7022587 mailed Apr. 23, 2012.

* cited by examiner

TURBINE BLADE STRUCTURE

RELATED APPLICATIONS

The present application is based on International Application Number PCT/JP2009/058080 filed Apr. 23, 2009, and claims priority from Japanese Application Number 2008-122460 filed May 8, 2008, the disclosures of which are hereby incorporated by reference herein in their entirety.

TECHNICAL FIELD

The present invention relates to a turbine blade (blade, vane) structure of a gas turbine.

BACKGROUND ART

Conventionally, in a gas turbine employed in power generation and the like, because high-temperature, high-pressure combustion gas passes through a turbine portion, cooling a turbine vane and the like has been important in order to maintain stable operation.

With respect to a blade of a gas turbine, an air passageway sectional shape that is capable of exhibiting a high cooling capability by air-cooling has been proposed. In this case, with an air passageway sectional shape wherein the cooling air flows toward the tip of the blade, the shape thereof is such that an edge on the airfoil pressure surface side is longer, whereas with an air passageway sectional shape wherein the cooling air can flow toward the basal end of the blade, the shape thereof is such that an edge on the airfoil suction surface side is longer (for example, see Patent Document 1).

With respect to a turbine vane of a gas turbine, an insert structure has been employed in order to make the turbine stator blade resistant to high temperatures. In this case, the blade cross-section is divided by sealing blocks in the blade longitudinal direction (for example, see Patent Document 2).

In addition, during operation of a gas turbine, the turbine blade environment differs between the suction side (convex side) of an airfoil and the pressure side (concave side) thereof. In other words, cooling is required on the blade pressure side where the thermal load is high; however, the need for cooling on the blade suction side, where the thermal load is small, is relatively small compared with the blade pressure side. On the other hand, because the ambient pressure on a surface of the airfoil is lower on the blade suction side compared to the blade pressure side, the cooling air introduced into the airfoil flows more toward the suction side where the pressure is low rather than the pressure side where the pressure is high. In order to improve such a biased cooling airflow inside the airfoil, a turbine blade structure has been proposed wherein partition members are provided that partition the insides of cavities located in the central portion of the blade, excluding the blade leading-edge side and the blade trailing-edge side, into a blade pressure side and a blade suction side along the center line of the blade, thereby isolating the blade pressure side cooling airflow and the blade suction side cooling airflow (for example, see Patent Document 3).

On the other hand, because the ambient pressure on a surface of the air foil is lower on the blade suction side compared to the blade pressure side, the cooling air introduced into the air foil flows more toward the suction side where the pressure is low rather than the pressure side where the pressure is high. In order to improve such a biased cooling airflow inside the air foil, a turbine blade structure has been proposed wherein partition members are provided that partition the insides of cavities located in the central portion of the blade, excluding the blade leading-edge side and the blade trailing-edge side, into a blade pressure side and a blade suction side along the center line of the blade, thereby isolating the blade pressure side cooling airflow and the blade suction side cooling airflow (for example, see Patent Document 3).

Patent Document 1: Japanese Unexamined Patent Application, Publication No. Hei 6-42301.

Patent Document 2: Japanese Unexamined Patent Application, Publication No. Hei 11-2103.

Patent Document 3: Japanese Unexamined Patent Application, Publication No. Hei 9-41903.

DISCLOSURE OF INVENTION

Turbine blades, in general, are manufactured by precision casting. In this case, in the process of setting of molten metal poured into a mold, differences in cooling rate of the molten metal depending on the structure of the blade may produce cast products of varying quality. In the case of the turbine blade structure disclosed in Patent Document 3 in particular, there is a problem in that the quality of cast products may not be uniform as a result of a delayed cooling rate due to a relatively large wall thickness, compared with the other nearby blade wall portions, in intersecting portions (for example, cross-shaped portions and T-shaped portions) between the central partition provided along the blade center line from the blade leading-edge side to the blade trailing-edge side and rib members provided to partition the space between the blade pressure side and the blade suction side into a plurality of cavities.

The present invention has been conceived in light of the above situation, and an object thereof is to provide a turbine blade structure that is capable of suppressing the quality variation of cast products during the manufacturing of a turbine blade.

In order to solve the problem described above, the present invention employs the following solutions. A turbine blade structure according to the present invention is a turbine blade structure wherein a space inside an airfoil is divided into a plurality of cavities, partitioned by rib members provided substantially perpendicular to a center line connecting a leading edge and a trailing edge, having partition members that partition insides of the cavities located in the central portion of the blade, excluding the blade leading-edge side and the blade trailing-edge side, into a blade pressure side and a blade suction side substantially along the center line, wherein blade leading-edge end portions and blade trailing-edge end portions of the partition member are inserted from one shroud surface side to the other shroud surface side along engagement grooves formed on the rib members.

With such a turbine blade structure, because partition members are provided, partitioning the insides of the cavities located in the central portion of the blade, excluding the blade leading-edge side and the blade trailing-edge side, into the blade pressure side and the blade suction side substantially along the center line, and because the blade leading-edge end portions and the blade trailing-edge end portions of the partition members are inserted from one shroud surface side to the other shroud surface side along the engagement grooves formed on the rib members, the partition members that partition the insides of the cavities and the airfoil including the rib members are manufactured as separate pieces having a structure where the partition members manufactured as separate pieces are attached afterwards; thus, it is possible to keep the quality variations small during the manufacturing of a turbine blade compared with a turbine blade structure whose partitions having the identical function are one-piece molded by precision molding. In this case, it is preferable that the partition members be provided with spring structures, thereby making it possible to absorb the thermal stress and pressure fluctuation occurring due to a temperature difference between the inside and the outside of the cavity.

In the above-described invention, in spaces between the partition members and the engagement grooves, sealing mechanisms may be provided to have a structure wherein the partitions are detachable between the blade pressure side and the blade suction side where the internal pressures differ; or alternatively, the structure may be such that the spaces can be joined and sealed by brazing.

According to the present invention described above, it is possible to reduce the quality variations during the manufacturing of the turbine blades, because the partition members are structured as separate pieces, which are inserted and fixed into the engagement grooves.

EXPLANATION OF REFERENCE SIGNS

Figure 1A:
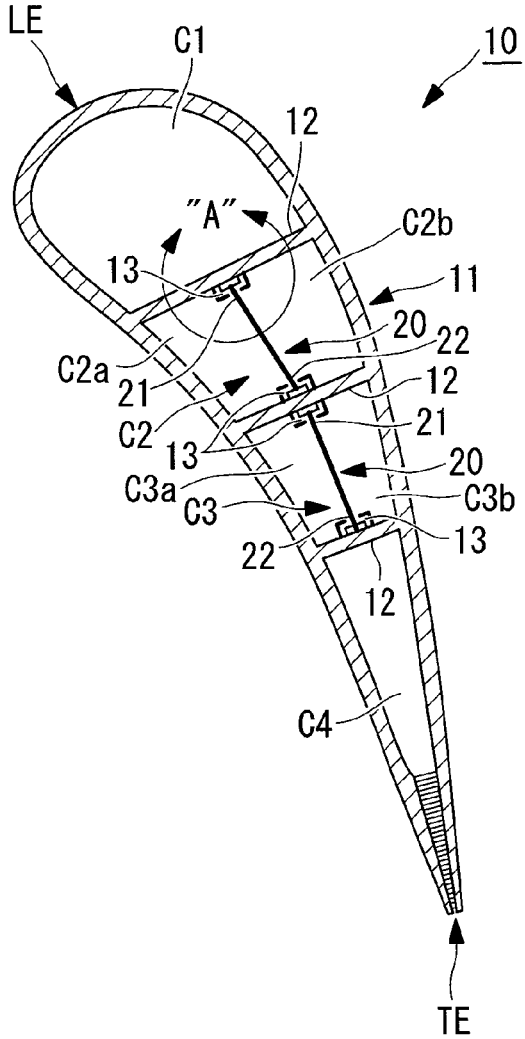
FIG. 1A is a cross-sectional view showing the internal structure of a vane serving as a first embodiment of a turbine blade structure according to the present invention.

10: first-stage vane (vane)
11: air foil
12: rib member
13: engagement groove
13: penetrating portion
20, 20', 20A-20C: partition member
21: blade leading-edge end portion
21*a*: locking portion
22: blade trailing-edge end portion
30, 30A-30C: sealing mechanism
LE: leading edge
TE: trailing edge
C1, C2, C3, C4: cavity
C2*a*, C3*a*: blade pressure side cavity
C2*b*, C3*b*: blade suction side cavity

BEST MODE FOR CARRYING OUT THE INVENTION

An embodiment of a turbine blade according to the present invention will be described below based on the drawings.

Figure 6:
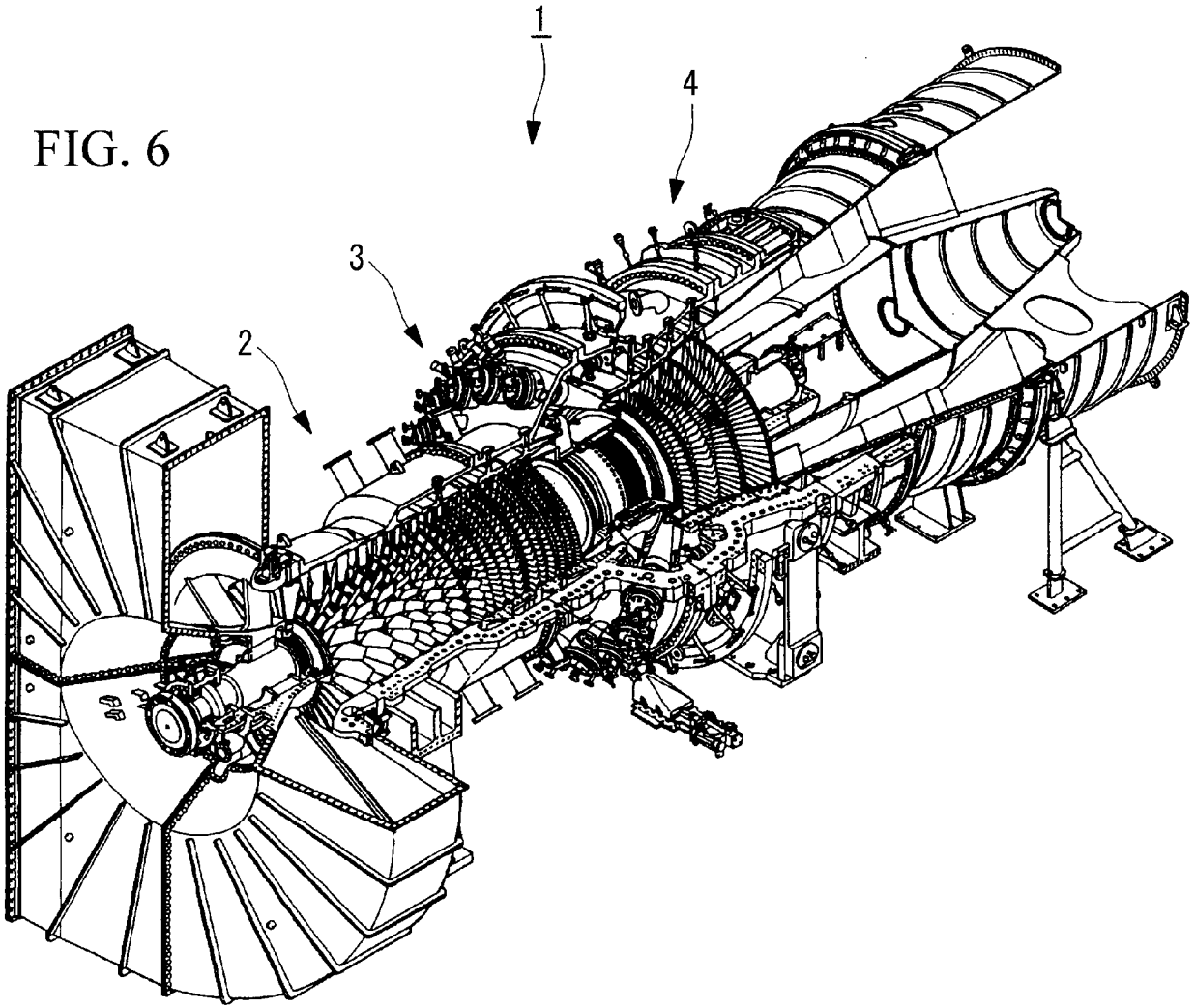
FIG. 6, which is a diagram showing a gas turbine equipped with the turbine blade structure according to the present invention, is a schematic perspective view showing a state with the upper half of the housing removed.

As shown in FIG. 6, a gas turbine 1 includes, as main elements, a compression unit (compressor) 2 that compresses combustion air, a combustion unit (combustor) 3 that generates high-temperature combustion gas by injecting fuel into the high-pressure air sent from this compression unit 2 thereby causing its combustion, and a turbine unit (turbine) 4 that is positioned downstream of this combustion unit 3 and that is driven by the combustion gas ejected from the combustion unit 3.

A turbine blade structure according to this embodiment can be applied to, for example, a first-stage vane in the turbine unit 4.

FIG. 1A shows one example of a turbine blade structure according to a first embodiment. That is, FIG. 1A shows the internal structure of the first-stage vane ("vane" hereafter) 10 of the turbine unit 4 in cross-section. This cross-section is taken in a substantially central portion of the vane 10 along a plane substantially perpendicular to the standing direction axis thereof.

In the vane 10 shown in the figure, the space formed inside an airfoil 11 is sectioned into a plurality of cavities partitioned by partition members 20, described later, and rib members 12 provided so as to be substantially perpendicular to the center line (not shown) connecting a leading edge LE and a trailing edge TE. In other words, the internal space of the airfoil 11 is divided into four cavities C1, C2, C3, and C4 by three rib members 12 so as to be substantially perpendicular to the center line; furthermore, the two cavities C2 and C3, located in the central portion in the chord longitudinal direction, are divided into two sections by the partition members 20 into blade pressure side cavities C2*a* and C3*a* and blade suction side cavities C2*b* and C3*b*, respectively.

In the embodiment shown in the figure, because the center line direction described above is divided into the four cavities C1, C2, C3, and C4, the cavities C2 and C3 in the central portion, excluding the cavity C1 located closest to the leading edge LE and the cavity C4 located closest to the trailing edge TE, are divided into two sections by providing the partition members 20. However, even if the number of divisions in the center line direction is changed, cavities in the central portion excluding cavities at both ends, located closest to the leading edge LE and closest to be trailing edge, will still be divided into two sections by providing the partition members 20.

Therefore, when the center line direction is divided into three, for example, the partition member 20 is provided only in one cavity that constitutes the central portion; and when the central line direction is divided into five, the partition members 20 are provided in three cavities that constitute the central portion.

The partition members 20 are plate-like members that partition the inside of the cavities C2 and C3, located in the blade central portion, substantially along the center line connecting the leading edge LE and the trailing edge TE, into the blade pressure side cavities C2*a* and C3*a* and the blade suction side cavities C2*b* and C3*b*. That is, the partition members 20 are plate-like members that block the flow of the cooling air between the blade pressure side and the blade suction side.

These partition members 20 are mounted by inserting blade leading-edge end portions 21 and blade trailing-edge end portions 22 along engagement grooves 13 formed on the rib members 12, from one shroud surface side of the vane 10 toward the other shroud surface side thereof.

The engagement grooves 13 are guiding grooves extending from one shroud surface side to the other shroud surface side and are provided in each of the opposing rib members 12 forming the cavities C2 and C3.

The engagement grooves 13 have rectangular sectional shapes into which locking portions 21*a*, having a substantially angular U-shaped profile and provided at the blade leading-edge end portions 21 of the partition members 20, can be smoothly inserted and are provided with penetrating portions 13*a* through which the partition members 20 pass. In other words, when the locking portions 21*a* of the partition members 20 are inserted from the outside shroud surface side, the locking portions 21*a*, being larger than the width of the penetrating portions 13*a*, cannot pass through in the center line direction.

Note that the engagement grooves 13 are also provided at the blade trailing-edge end portions 22 in a similar manner as in the above-described blade leading-edge end portions 21.

In addition, the engagement grooves 13 and the locking portions 21*a* described above, for example, as shown in FIG. 1B, also function as a sealing mechanism 30 that blocks the flow of the cooling air between the blade pressure side cavity C2*a* and the blade suction side cavity C2*b* separated by the partition member 20. The sealing mechanism 30 shown in the figure is a labyrinth seal mechanism composed of the locking portions 21*a*, having angular U-shaped profiles, and one or a plurality of protrusions 14 provided on the rib members 12. When the temperature of the main airfoil 11 and its surroundings, etc. rises during operation of the gas turbine 1, the temperature inside the cavities is lower relative to the outside of the airfoil 11; therefore, in this sealing mechanism 30, the partition members 20 expand relatively outward depending on the values of the elastic modulus and the thermal expansion rate. As a result, the tip portions of the locking portions 21*a* become abutted to the wall surfaces of the rib members 12; therefore, the labyrinth seal function is achieved by the sealing mechanism 30, and the pressure difference generated between the blade pressure side cavity C2*a* and the blade suction side cavity C2*b* can be maintained.

Figure 2:
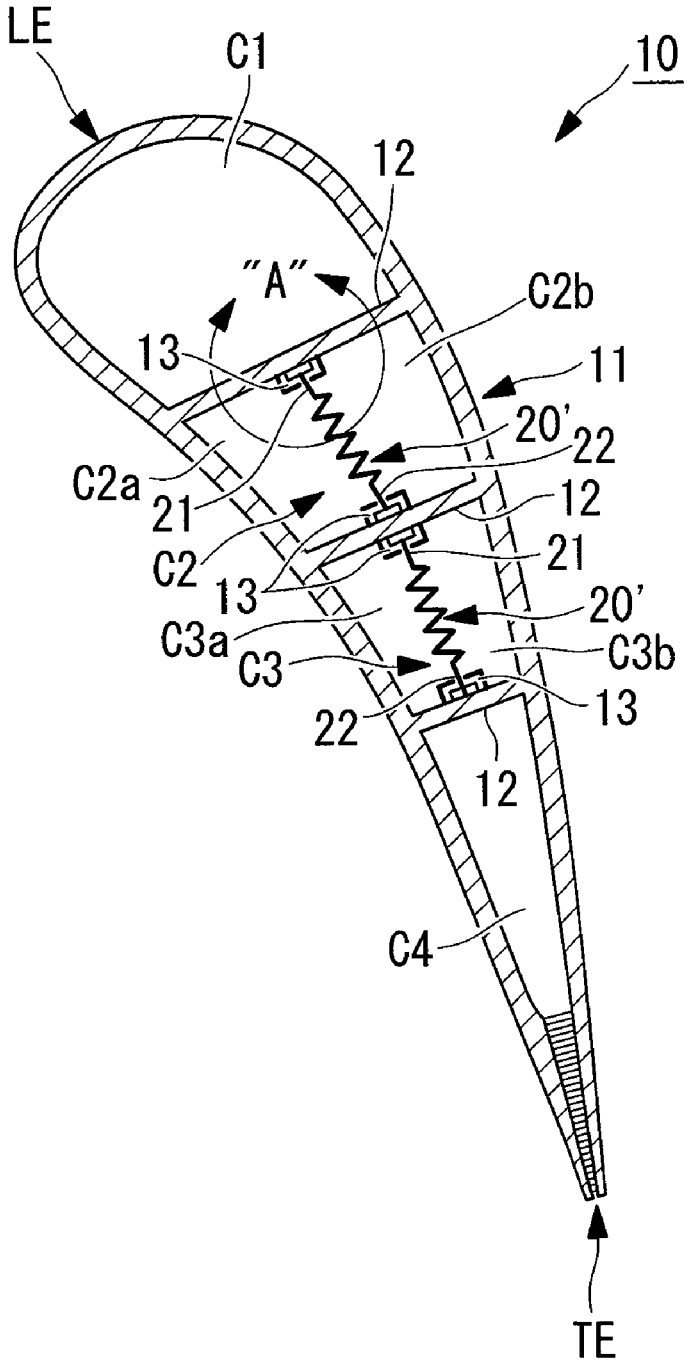
FIG. 2 is a cross-sectional view showing the internal structure of a vane serving as a second embodiment of a turbine blade structure according to the present invention.

In addition, with a second embodiment shown in FIG. 2, spring structured members are employed as partition members 20', instead of the partition members 20 described above, which are plate-like members. Note that identical reference numerals are given to portions identical to those in the first embodiment described above, and detailed descriptions thereof are omitted. The partition members 20' are elastic, expanding and contracting in the blade center line direction, and have plate-like spring structures to block the flow of the cooling air between the blade pressure side and the blade suction side. Even when a temperature distribution is generated in airfoil structural members, exerting thermal stress on the partition members due to differential thermal expansion, the partition members 20' having such spring structures can suppress thermal stress since the spring structured members absorb the differential thermal expansion.

Figure 1B:
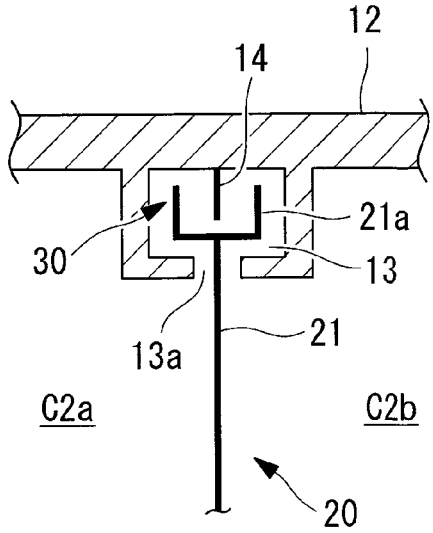
FIG. 1B is an expanded view of the portion A of FIG. 1A.
Figure 3:
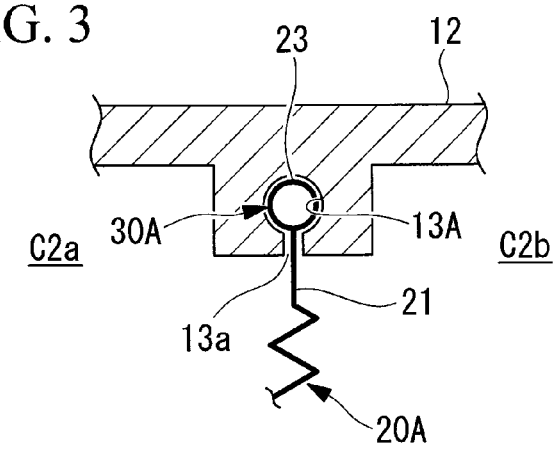
FIG. 3 is an expanded sectional view showing the main portion of a first modification of FIG. 1B.

As a first modification of the sealing mechanism 30 shown in FIG. 1B, FIG. 3 shows a case in which spring structured members are employed as partition members 20A; however, they may be plate-like members. In this case, the sealing mechanism 30A is composed of locking rings 23, having substantially circular profiles, provided at the leading-edge end portions 21 and the trailing-edge end portions 22 of the partition members 20A, and engagement grooves 13A provided on the rib members 12.

In this case, the engagement grooves 13A have substantially circular sectional shapes into which the locking rings 23 can be smoothly inserted and are provided with penetrating portions 13*a* through which the partition members 20A pass. In other words, when the locking rings 23 of the partition members 20A are inserted from the outside shroud surface side, the locking rings 23, being larger than the width of the penetrating portions 13*a*, cannot pass through in the center line direction.

When the temperature inside the cavities becomes lower than the outside the airfoil 11 during operation of the gas turbine 1, in this sealing mechanism 30A, the spring structures of the partition members 20A expand relatively outward depending on the values of the elastic modulus and the thermal expansion rate. As a result, the outer peripheral surfaces of the locking rings 23 become abutted to the inner wall surfaces of the engagement grooves 13A; therefore, the sealing function is achieved by the sealing mechanism 30A, and the pressure difference generated between the blade pressure side cavity C2*a* and the blade suction side cavity C2*b* can be maintained.

Figure 4:
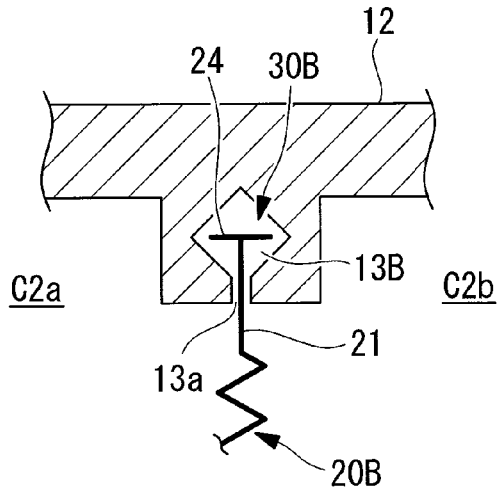
FIG. 4 is an expanded sectional view showing the main portion of a second modification of FIG. 1B.

As a second modification of the sealing mechanism 30 shown in FIG. 1B, FIG. 4 shows a case in which spring structured members are employed as partition members 20B; however, they may be plate-like members. In this case, the sealing mechanism 30B is composed of plate-like members 24 provided at the leading-edge end portions 21 and the trailing-edge end portions 22 of the partition members 20B, and engagement grooves 13B provided on the rib members 12.

The engagement grooves 13B in this case have a rectangular sectional shape into which the plate-like members 24 can be diagonally and smoothly inserted and are provided with penetrating portions 13*a* through which the partition members 20B pass. In other words, when the plate-like members 24 of the partition members 20B are inserted from the outside shroud surface side, the plate-like members 24, being larger than the width of the penetrating portions 13*a*, cannot pass through in the center line direction.

When the temperature inside the cavities becomes lower than the outside of the airfoil 11 during operation of the gas turbine 1, in this sealing mechanism 30B, the spring structures of the partition members 20B expand relatively outward depending on the values of the elastic modulus and the thermal expansion rate. As a result, the plate-like members 24 become abutted to the inner wall surfaces of the engagement grooves 13B; therefore, the sealing function is achieved by the sealing mechanism 30B, and the pressure difference generated between the blade pressure side cavity C2*a* and the blade suction side cavity C2*b* can be maintained.

Figure 5:
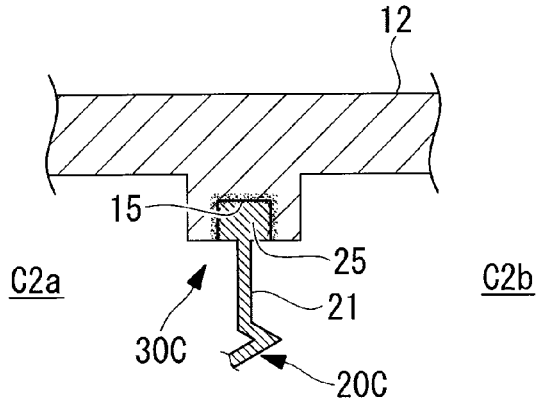
FIG. 5 is an expanded sectional view showing the main portion of a third modification of FIG. 1B.

As a third modification of the sealing mechanism 30 shown in FIG. 1B, FIG. 5 shows a case in which spring structured members are employed as partition members 20C; however, they may be plate-like members. In the sealing structure 30C in this case, the leading-edge end portions 21 and the trailing-edge end portions 22 of the partition members 20C are fixed to the rib members 12 by brazing. In the example shown in the figure, concave grooved portions 15 are formed on the rib members 12, rectangular profile portions 25 provided at the tip portions of the leading-edge end portions 21 and the trailing-edge end portions 25 are engaged with these concave grooved portions 15, and the three surfaces where the concave grooved portions 15 and the rectangular profile portions 25 come in contact are brazed.

With such a configuration, because the sealing structure 30C formed by brazing is provided, the pressure difference generated between the blade pressure side cavity C2*a* and the blade suction side cavity C2*b* can be maintained, and both ends of the partition members 20C can be fixedly supported on the rib members 12.

In this way, with the above-described turbine blade structure according to the present invention, because the partition members 20 have separate-piece structures whereby they are inserted and fixed into the engagement grooves 13 of the rib members 12, it is possible to suppress quality variations of turbine blade cast products compared with a structure whose partition members are one-piece molded by precision molding. In other words, when the partition members 20 are one-piece molded by precision molding, the quality of finished cast products may not be uniform because the cooling rate, in the process of setting of the poured molten metal, becomes lower in portions where the partition members 20 and the rib members 12 intersect, where the wall thickness is relatively large compared with the other blade wall members.

On the other hand, when the partition members are manufactured as separate pieces from other blade structural members, including the rib members 12, intersecting portions between the partition members 20 and the rib members 12 as described above do not occur in the structures of blade structural members manufactured by precision molding; therefore, nonuniformity in the cooling rate among the blade structural members during the precision molding is reduced, and the problem with the quality of the cast products does not occur.

In addition, because the spring structures of the partition members 20 expand and contract to absorb the thermal stress and cooling air pressure fluctuations generated during operation of the gas turbine 1, reliability and durability are also superior.

In the above-described embodiments, the turbine blade is described as the first-stage vane 10; however, it is possible to apply the identical structure to other vanes or blades.

Note that the present invention is not limited to the embodiments described above, and various modifications can be made without departing from the spirit of the present invention.

The invention claimed is:

1. A turbine blade structure, comprising: an airfoil having a leading edge, a trailing edge, and a space therewithin divided into a plurality of cavities, partitioned by rib members provided substantially perpendicular to a center line connecting said leading edge and said trailing edge, the plurality of cavities including a cavity located in a leading-edge side of a blade, a cavity located in a trailing-edge side of the blade, and the cavities located in a central portion of the blade between the leading-edge side and the trailing-edge side, a plurality of partition members that partition insides of the cavities located in the central portion of the blade into a blade pressure side and a blade suction side substantially along the center line, said rib members having engagement grooves, a labyrinth seal mechanism disposed between the partition members and the engagement grooves, and wherein blade leading-edge end portions and blade trailing-edge end portions of the partition members are inserted from one shroud surface side to the other shroud surface side along engagement grooves formed on the rib members.

2. A turbine blade structure wherein a space inside an airfoil is divided into a plurality of cavities, partitioned by rib members provided substantially perpendicular to a center line connecting a leading edge and a trailing edge, the turbine blade structure comprising:

partition members that partition insides of the cavities located in the central portion of the blade into a blade pressure side and a blade suction side substantially along the center line, wherein blade leading-edge end portions and blade trailing-edge end portions of the partition members are inserted from one shroud surface side to the other shroud surface side along engagement grooves formed on the rib members, wherein the partition members comprise spring structures.

3. The turbine blade structure according to claim 2, wherein the partition members and the engagement grooves are brazed therebetween.

* * * * *